US006953267B1

(12) United States Patent
Cunningham

(10) Patent No.: US 6,953,267 B1
(45) Date of Patent: Oct. 11, 2005

(54) LIGHT FIXTURE

(75) Inventor: Andrew W. Cunningham, Kohimarama (NZ)

(73) Assignee: Hunza Productions Ltd., Auckland (NZ)

( * ) Notice: Subject to any disclaimer, the term of this patent is extended or adjusted under 35 U.S.C. 154(b) by 0 days.

(21) Appl. No.: 10/402,177

(22) Filed: Mar. 27, 2003

Related U.S. Application Data

(60) Provisional application No. 60/369,516, filed on Apr. 1, 2002.

(51) Int. Cl.[7] ..... F21V 29/00

(52) U.S. Cl. ..... 362/267; 362/310; 362/158

(58) Field of Search ..... 362/310, 267, 362/296, 297, 353, 326, 158, 374, 375; 313/112, 313/116, 117

(56) References Cited

U.S. PATENT DOCUMENTS

| | | | | |
|---|---|---|---|---|
| 4,156,891 | A * | 5/1979 | Roche | 362/20 |
| 6,053,623 | A * | 4/2000 | Jones et al. | 362/310 |
| D443,940 | S | 6/2001 | Donato | |
| D443,942 | S | 6/2001 | Dye et al. | |
| D443,943 | S | 6/2001 | Brunner et al. | |
| D443,948 | S | 6/2001 | Tortosa | |
| 6,357,892 | B1 | 3/2002 | Beadle | |
| 6,705,748 | B2 * | 3/2004 | Morris | 362/310 |

* cited by examiner

*Primary Examiner*—Sandra O'Shea
*Assistant Examiner*—Bao Q Truong
(74) *Attorney, Agent, or Firm*—Speckman Law Group PLLC; Janet Sleath; Ann W. Speckman

(57) ABSTRACT

The present invention provides a light fixture that is sealed against the entry of water and can therefore be readily employed in outdoor locations. The inventive light fixture, which incorporates a halogen lamp, can be readily opened without the use of tools for replacement of the lamp.

20 Claims, 4 Drawing Sheets

LIGHT FIXTURE

REFERENCE TO RELATED APPLICATIONS

This application claims priority to U.S. Provisional Patent Application No. 60/369,516, filed Apr. 1, 2002.

TECHNICAL FIELD OF THE INVENTION

The present invention relates to light fixtures that include a halogen lamp. More specifically, the present invention relates to light fixtures for outdoor use.

BACKGROUND OF THE INVENTION

Outdoor lighting is frequently employed in commercial, public and residential locations in order to enhance the safety and appearance of outdoor locations and to provide improved security. For example, outdoor light fixtures are used to illuminate walkways and stairs thereby increasing the safety of persons using the walkways and stairs in the dark. Such light fixtures are frequently placed in locations where they are exposed to the weather. It is thus important that the fixtures be completely sealed in order to prevent the entry of moisture into the fixtures.

Many light fixtures currently employed outdoors are vulnerable to corrosion due to seepage of water into the fixtures. In addition, maintenance of such fixtures, i.e. changing of burnt-out lamps, frequently requires the use of tools and can compromise the water resistance of the features. There thus remains a need in the art for light fixtures for outdoor use that are robust, reliable, resistant to corrosion and easy to maintain.

SUMMARY OF THE INVENTION

The present invention provides a light fixture that is sealed against the entry of water and can therefore be readily employed in outdoor locations. The inventive light fixture incorporates a halogen lamp and can be easily opened and closed without the use of tools for replacement of the halogen lamp.

In one embodiment, the inventive light fixture comprises a hollow light body, or housing, which is preferably cylindrical shape. A halogen lamp is placed within the light housing, with a lip provided around the upper circumference of the lamp resting on a ledge provided around the inner circumference of the light housing, in proximity to its upper end. A lens contacts, and covers, the upper surface of the halogen lamp, with a gasket of approximately the same outer circumference as the lens being placed on the upper surface of the lens. A lens ring, which is sized to fit over the upper edge of the light housing, is provided with a thread which matches and threadably engages a thread provided on the outer surface of the light housing at its upper end. When the lens ring is screwed onto the light housing, it pushes down and outwards on the gasket, which in turn presses down on the lens, thereby sealing the light fixture and preventing the entry of moisture into the light housing.

The inventive light fixture may be mounted within a structure, such as a wall or pathway, or may be mounted externally, such as on the surface of a wall or on a pole for insertion in the ground, such as in a flower bed. The light fixture of the present invention may thus be usefully employed for illuminating walkways, stairs, decks, driveways, trees, shrubs and other landscaping or architectural features.

The light fixtures disclosed herein are more robust, reliable and resistant to corrosion that most other fixtures currently employed for outside locations. The sealing feature of the inventive fixtures enables easy replacement of lamps while ensuring that the seal is not compromised during standard maintenance procedures. Furthermore, no tools are required for performing standard maintenance.

DETAILED DESCRIPTION

Figure 1:
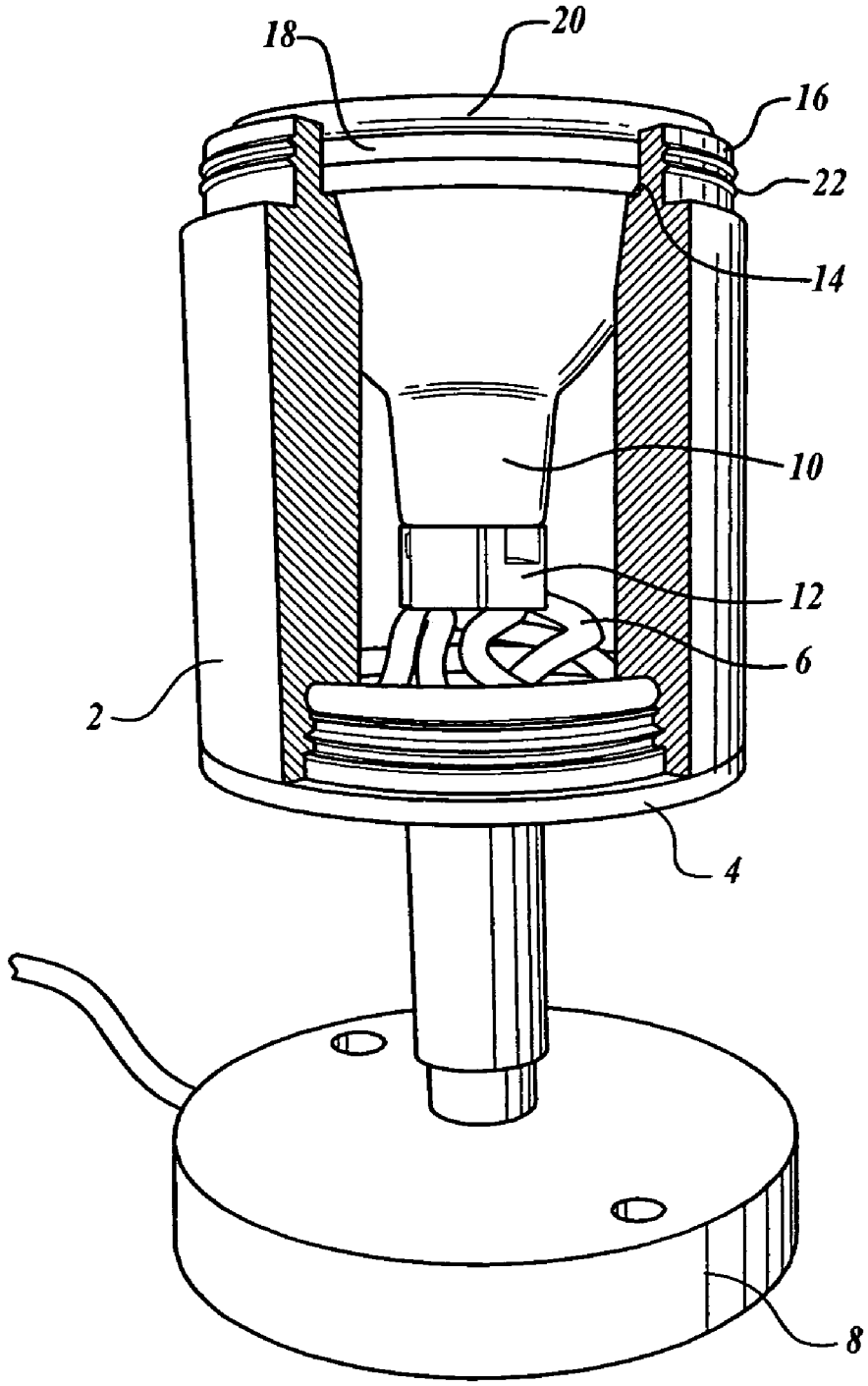
FIG. 1 is a cross-sectional view of a light fixture of the present invention.
Figure 2:
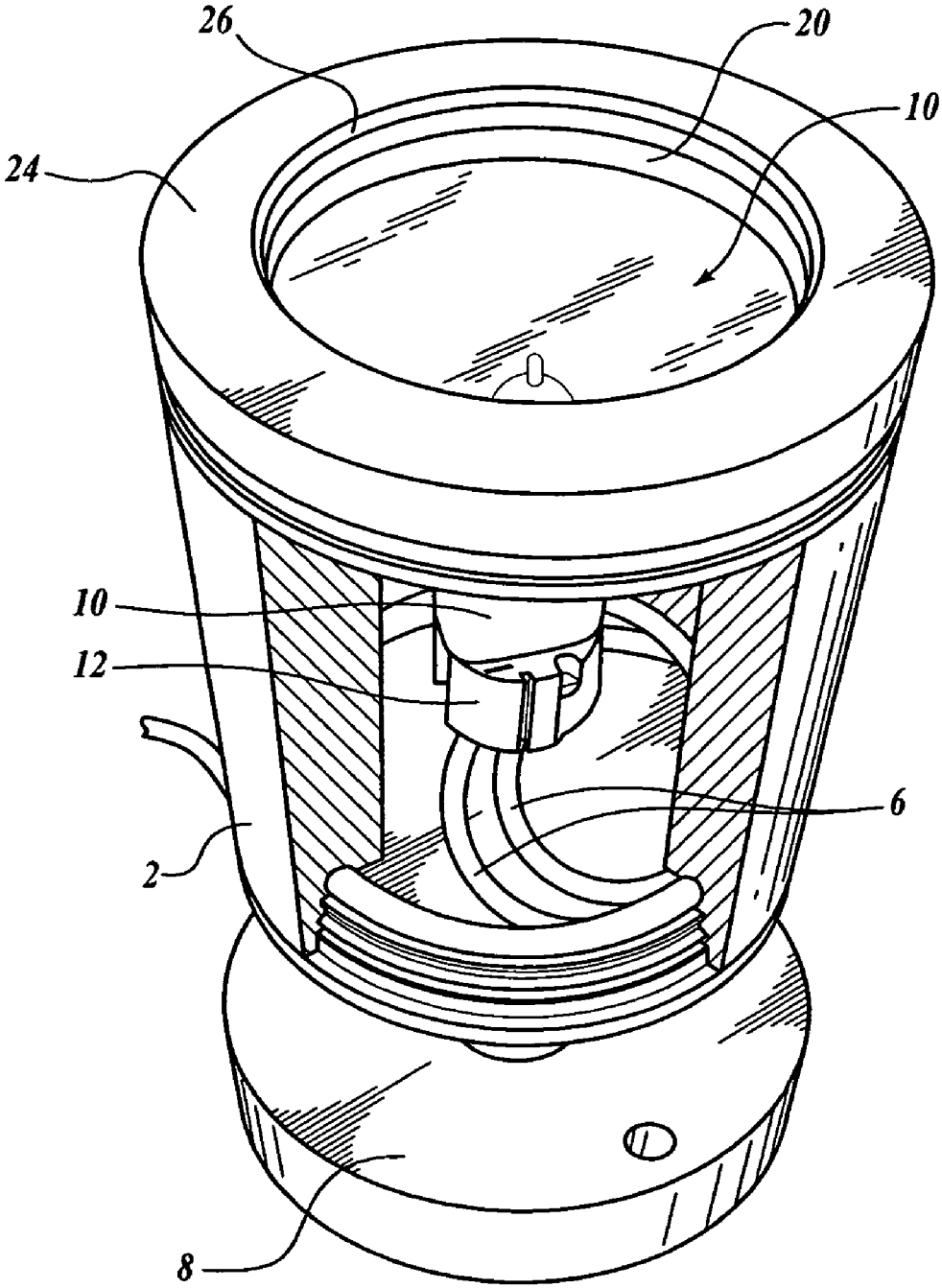
FIG. 2 is a perspective view of a light fixture of the present invention.

FIGS. 1 and 2 illustrate one embodiment of a light fixture of the present invention. Light housing 2 which is generally cylindrical in shape, is constructed of a rigid material, such as stainless steel, aluminum or copper, and is sealed at its base by means of end cap 4. End cap 4 screws onto light housing 2 and is provided with an opening (not shown) for entry of electrical wires 6. Light housing 2 may, alternatively, be provided with a base that is an integral part of the light housing. In the illustrated embodiment, light housing 2 is mounted on support base 8 which may be attached to a surface, such as a deck or walkway.

Halogen lamp 10, which has a generally conical shape, is placed within light housing 2 and is supported by lamp holder 12. Lamp 10 may be securely held in contact with holder 12 by means of two pins (not shown) which protrude from the base of lamp 10 and into corresponding holes provided in the top of holder 12. At it's upper edge, lamp 10 rests on ledge 14 provided around the circumference of light housing 2 in proximity to its upper end 16 which is distal to end cap 4. Halogen lamp 10, which comprises a bulb sealed within a halogen filled housing, is preferably an MR16 lamp which can be readily purchased from, for example, General Electric Lighting, and are available in a variety of wattages, such as 20 watt and 50 watt, with several different beam angles. Other halogen lamps which may be employed in the inventive light fixture include MR11 lamps. Lamp holder 12 is preferably ceramic, and may be of any design well known to those of skill in the art for use with halogen lamps.

Figure 3:
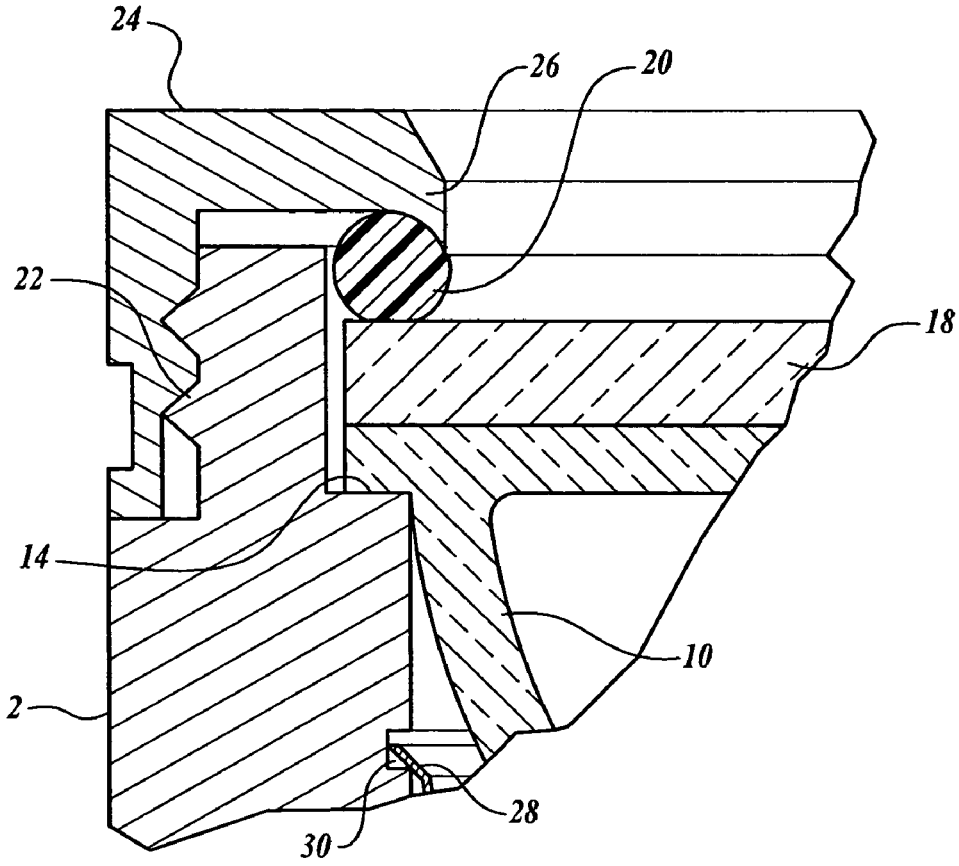
FIG. 3 is a side view of an upper portion of a light fixture of the present invention.

As shown in FIG. 3, circular lens 18 rests on, and covers, the upper surface of halogen lamp 10, and is essentially flat. Lens 18 is preferably constructed of glass, most preferably of tempered glass, which can be either clear or frosted to reduce glare. Gasket 20, which is preferably made of high temperature silicon, is positioned on top of outer circumference of lens 18. At upper end 16, the outer surface of light housing 2 is provided with a thread 22 which threadably engages lens ring 24 (shown in FIG. 2). Lens ring 24, which is preferably constructed of stainless steel, aluminum or copper is provided with lip 26. When lens ring 24 is screwed onto thread 22 on light housing 2, it pushes down and outwards on gasket 20 which in turns pushes down on lens 18, thereby pressing the lower surface of lens 18 onto the upper surface of halogen lamp 10 and sealing the upper end of light housing 2.

Figure 4:
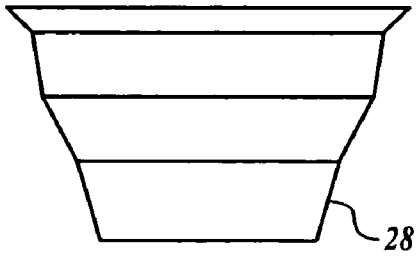
FIG. 4 is a side view of a reflector employed in one embodiment of the present invention.
Figure 5:
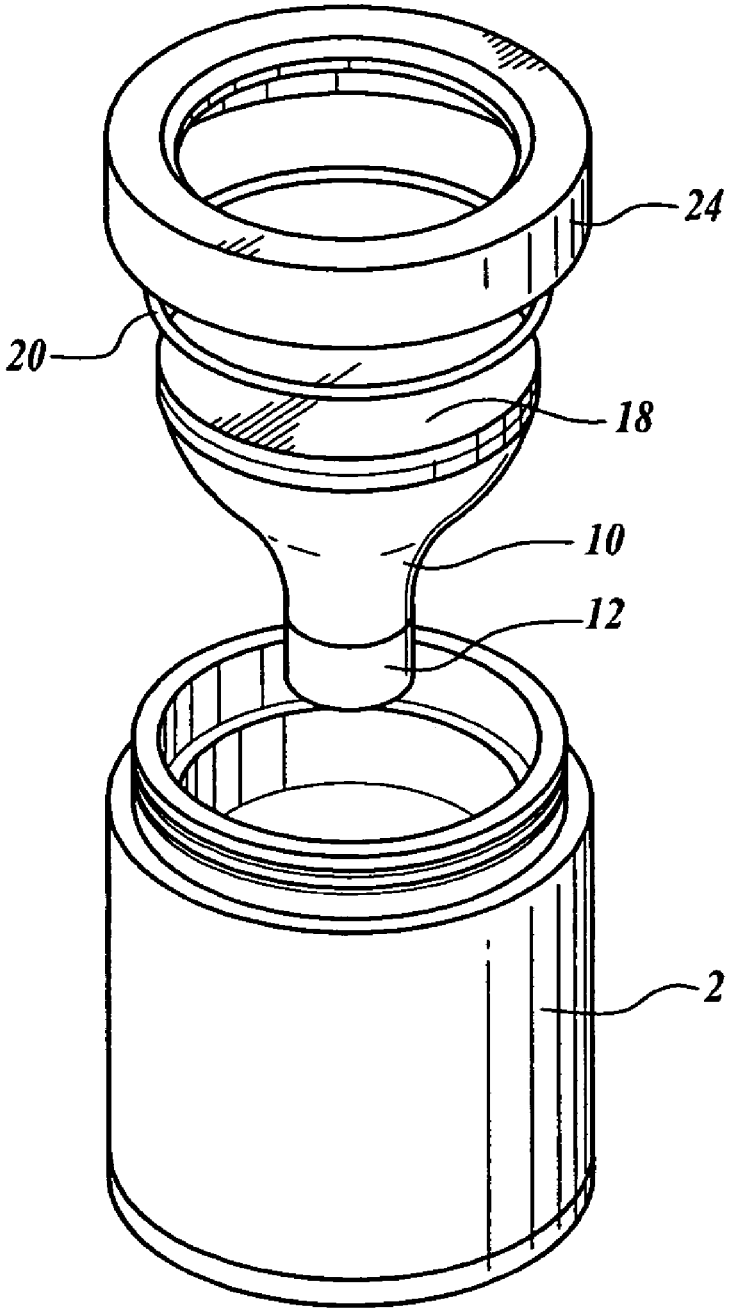
FIG. 5 is an exploded perspective view of a light fixture of the present invention.

In one embodiment, the inventive light fixture is provided with a reflector 28 (illustrated in FIGS. 3 and 4) which has a generally conical shape and which rests on notch 30 provided around the circumference of light body 2. Reflector 28 covers at least a portion of the outer surface of halogen lamp 10 and serves to reflect heat generated by halogen lamp 10 outwards towards lens 18.

In order to replace halogen lamp 10, lens ring 24 is unscrewed from upper end 16 of light body 2, gasket 20 and lens 18 are removed, and lamp 10 is simply pulled out of holder 12. A replacement lamp can then be placed in holder 12, lens 18 and gasket 20 placed back on top of the lamp, and lens ring 24 screwed back into place. Replacement of burnt-out lamps in the inventive light fixtures can thus be accomplished quickly and easily without the use of tools.

While in the foregoing specification this invention has been described in relation to certain preferred embodiments, and many details have been set forth for purpose of illustration, it will be apparent to those skilled in the art that the invention is susceptible to additional embodiments and that certain of the details described herein may be varied considerably without departing from the basic principles of the invention.

I claim:

1. A light fixture comprising:

(a) a light housing being sealed at a first base end and having a thread on its outer surface in proximity to a second upper end;

(b) a halogen lamp positioned inside the light housing, the halogen lamp having a lip around its upper circumference which rests on a ledge provided around an inner circumference of the light housing in proximity to the second upper end of the light housing;

(c) a lens covering an upper surface of the halogen lamp;

(d) a gasket positioned on top of an outer circumference of the lens; and (e) a lens ring sized to fit over the second upper end of the light housing and having a thread for threadably engaging the thread provided on the second end of the light housing;

wherein, when the lens ring engages the thread provided on the light housing, the gasket is pushed down onto the lens thereby sealing the light fixture against the entry of water.

2. The light fixture according to claim 1, wherein said light housing is constructed of a material selected from the group consisting of: stainless steel, aluminum, and copper.

3. The light fixture according to claim 1, wherein said first end is sealed by an end cap, the end cap being provided with an opening for entry of electrical wires.

4. The light fixture according to claim 1, wherein said light housing is mounted on a support base.

5. The light fixture according to claim 1, wherein said halogen lamp is supported by a lamp holder.

6. The light fixture according to claim 5, wherein said halogen lamp and said lamp holder are connected by at least two pins, said pins protruding from a base of said halogen lamp into corresponding holes provided on top of said lamp holder.

7. The light fixture according to claim 1, wherein said halogen lamp is selected from the group consisting of: MR16 lamps and MR11 lamps.

8. The light fixture according to claim 1, wherein said lens is constructed from material selected from the group consisting of: glass, clear tempered glass, and frosted tempered glass.

9. The light fixture according to claim 1, wherein said lens ring comprises a lip which pushes down and outward on said gasket.

10. The light fixture according to claim 1, wherein said lens ring is constructed from material selected from the group consisting of: stainless steel, aluminum, and copper.

11. The light fixture according to claim 1, wherein said light fixture further comprises a reflector positioned around an inner circumference of said light housing.

12. The light fixture according to claim 11, wherein said reflector rests on a notch provided around said inner circumference of said light housing.

13. The light fixture according to claim 11, wherein said reflector covers at least a portion of the outer surface of said halogen lamp.

14. A light fixture comprising:

(a) a light housing being sealed at a first base end and having a thread on its outer surface in proximity to a second upper end;

(b) a ledge provided around an inner circumference of the light housing in proximity to the second upper end of the light housing for receiving a lip around an upper circumference of a halogen lamp;

(c) a lens sized and positioned to cover an upper surface of the halogen lamp;

(d) a gasket positioned on top of an outer circumference of the lens; and (e) a lens ring sized to fit over the second upper end of the light housing and having a thread for threadably engaging the thread provided on the second upper end of the light housing;

wherein, when the lens ring engages the thread provided on the light housing, the gasket is pushed down onto the lens thereby sealing the light fixture against the entry of water.

15. The light fixture according to claim 14, wherein said light housing is constructed of a material selected from the group consisting of: stainless steel; aluminum; and copper.

16. The light fixture according to claim 14, wherein said first lower end is sealed by an end cap, the end cap being provided with an opening for entry of electrical wires.

17. The light fixture according to claim 14, wherein said light housing is mounted on a support base.

18. The light fixture according to claim 14, wherein said lens ring comprises a lip which pushes down and outward on said gasket.

19. The light fixture according to claim 14, wherein said lens ring is constructed from material selected from the group consisting of: stainless steel; aluminum; and copper.

20. The light fixture according to claim 14, wherein said light fixture further comprises a reflector positioned around an inner circumference of said light housing.

* * * * *